US005453578A

United States Patent [19]

Ishii et al.

[11] Patent Number: 5,453,578

[45] Date of Patent: Sep. 26, 1995

[54] COVER FOR BOLT-SCREWED HIGH DENSITY MULTI-POLE CONNECTOR

[75] Inventors: Takashi Ishii; Tamio Watanabe; Toru Nagano, all of Shizuoka, Japan

[73] Assignee: Yazaki Corporation, Tokyo, Japan

[21] Appl. No.: 186,636

[22] Filed: Jan. 26, 1994

[30] Foreign Application Priority Data

Jan. 29, 1993 [JP] Japan ..... 5-013653

[51] Int. Cl.[6] ..... H01B 17/00

[52] U.S. Cl. ..... 174/138 R; 174/138 F; 439/364; 439/521

[58] Field of Search ..... 174/138 F, 138 R, 174/135; 439/364, 521, 522; D13/147, 156

[56] References Cited

U.S. PATENT DOCUMENTS 4,913,385 4/1990 Law et al. ..... 248/56
5,139,431 8/1992 Saitoh et al. ..... 439/364
5,295,756 3/1994 Ohta ..... 403/407.1
5,346,782 9/1994 Julian ..... 429/65

FOREIGN PATENT DOCUMENTS 92-12077 6/1992 Japan .

*Primary Examiner*—Morris H. Nimmo
*Attorney, Agent, or Firm*—Armstrong, Westerman, Hattori, McLeland and Naughton

[57] ABSTRACT

A cover for protecting a large number of electric wires in the housing in a bolt-screwed high-density multi-pole connector having a screw bolt. The cover is plate-shaped. The cover has an engagement hole corresponding to a bolt holder having a rectangular cylinder into which the screw bolt is inserted and a handle provided at one end where the electric wires are fixed and from which they are extracted. Thus, the cover can be easily mounted on the housing. With no fear of catching or breaking of electric wires, the direction of extracting the electric wires can be optionally selected. Further, the cover can be fabricated at low cost.

10 Claims, 5 Drawing Sheets

COVER FOR BOLT-SCREWED HIGH DENSITY MULTI-POLE CONNECTOR

BACKGROUND OF THE INVENTION

1. Field of the Invention

The present invention relates to a cover for a bolt-screwed high density multi-pole connector which is used for connection of e.g. a wire harness.

2. Description of the Prior Art

As shown in FIGS. 5A and 5B which are a perspective view and a cross sectional view of the prior art bolt-screwed high density multi-pole connector, respectively, it has a structure in which a male housing 2' is screwed and fixed to a female housing 2 by a screw bolt 1 which is previously inserted in the housing 2 through stop rings S and S.

A cover 4' having an outer box shape is put on the housing 2 in order to protect a group of electric wires connected to many connection terminals. The cover 2' is provided with a hole 5' from which a head 1*a* of the screw bolt 1 is exposed and a lock portion 4*b'* for the housing 2 and the a wire extracting hole 4*c'*.

The above prior art has the following defects. When the cover 4' is mounted on the housing 2, it was required that the electric wires 3 were crowded into the cover 4' so that they are not caught between the cover 4' and the housing 2 and between the head 1*a* of the screw bolt 1 and the hole 5' of the cover 4'. Therefore, the operation of mounting the cover 4' is troublesome. If there is no care, the electric wires 3 will be caught at the above portions, and broken as the case may be.

It is difficult to extract the electric wires in different directions from electric-wire extracting holes 4*c'* provided at two or more positions of the housing 2.

Further, since the cover 4' is formed in a box shape which wraps the entire group of electric wires 3, it is bulky and requires high cost to fabricate.

SUMMARY OF THE INVENTION

An object of the present invention is to provide a cover for a bolt-screwed high-density multi-pole connector which can be easily mounted for protecting electric wires, in which catching or breaking the electric wires does not occur, from which the electric wires can be extracted in any direction and which can be fabricated at low cost.

In order to attain the above object, in accordance with the present invention, there is provided a cover for protecting a large number of electric wires in a housing of a high density multi-pole connector having a screw bolt comprising a mating hole having a plate shape and corresponding to a bolt holder having a rectangular cylinder in which a screw bolt is inserted and a handle of fixing the electric wires by tape binding on at least one side of the cover.

In using the cover, the internal side on the approaching side of a mating hole is hung on the outer peripheral portion of a bolt holder having an outer rectangular cylindrical shape and a handle contrary to the approaching side is pressed down. Thus, the bolt holder is fit in the mating hole and the electric wires are fixed on the handle provided on the one side of the cover by tape binding.

The above and other objects and features of the present invention will be more apparent from the following description taken in conjunction with the accompanying drawings.

DESCRIPTION OF THE PREFERRED EMBODIMENTS

Figure 1A:
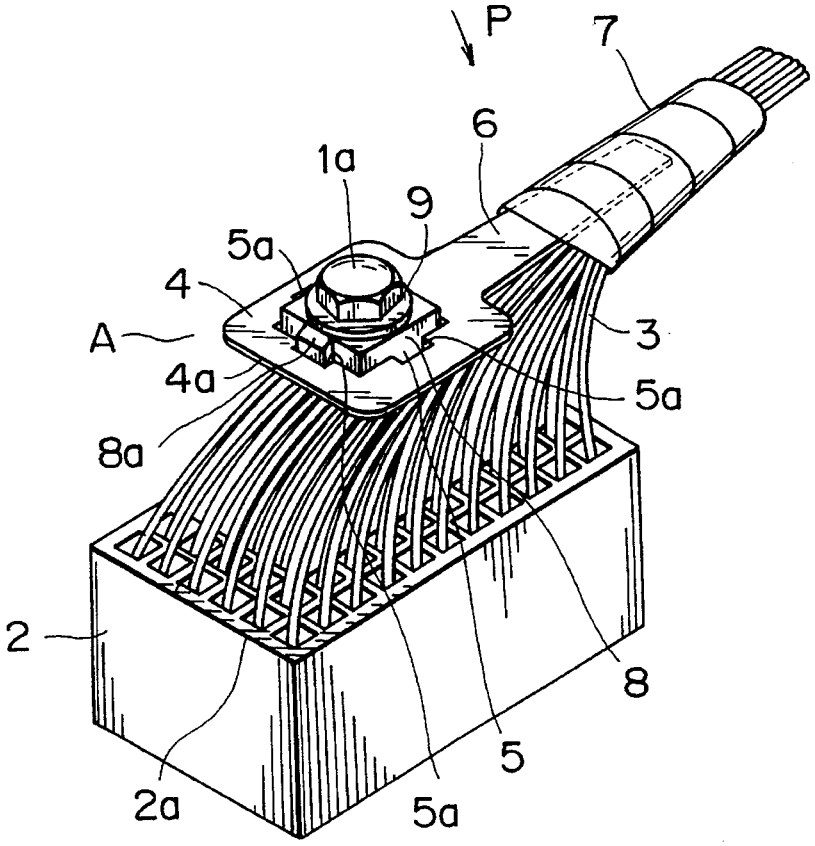
FIGS. 1A and 1C are perspective views of a first embodiment and a second embodiment, respectively, of a cover for the bolt-screwed high-density multi-pole connector when it is attached.

Now referring to FIGS. 1 to 4, an explanation will be given of embodiments of the present invention.

In FIG. 1, an element A denotes a cover for a high-density multi-pole connector of synthetic resin. The cover A is formed in an outer plate-shape cover 4 for protecting a large number of electric wires 3 on the upper surface of a female housing 2 having a screw bolt 1. The cover 4 is formed so as to have a handle 6 described later.

The cover 4 has a substantial square shape the one side 4*a* of which is formed so as to be slightly shorter than the shorter side of the housing 2. The cover 4 should be not limited to a square shape, but may be any shape such as a rectangle and ellipse as long as it has a size equal or smaller than that of the back face of the housing 2.

All the one sides of the cover 4 are made shorter than the shorter sides 2. This is because the cover 4 does not project from the outer periphery of the housing 2 even when the electric wires are extracted in any direction of a longer side or shorter side of the housing and the direction of extracting the electric wires 3.

An engagement hole 5 which is planar is formed so as to correspond to the bolt holder 8. The bolt holder 8 into which the screw bolt 1 is inserted can be fit in the engagement hole 5.

A handle 6 is formed at one end of the cover 4, and the electric wires 3 are fixed to the handle 6 by tape binding.

Figure 1B:
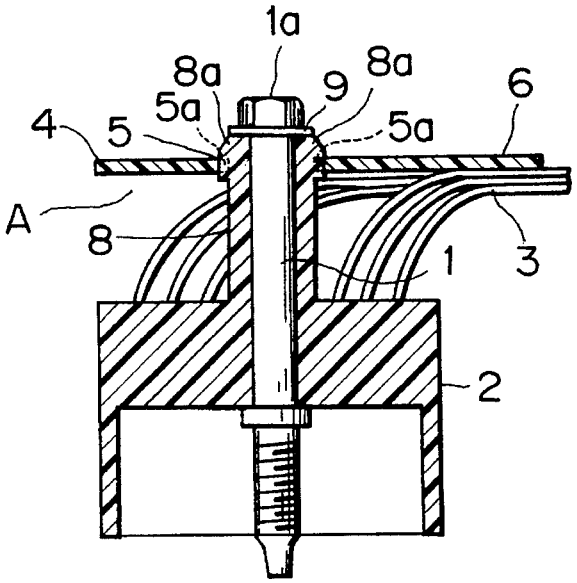
FIGS. 1B and 1D are cross sectional views of the cover shown in FIGS. 1A and 1C, respectively.

Although only one handle is provided at the one end of the cover 4 in the example of FIGS. 1A and 1B, if there are plural directions of extracting the electric wires 3, the number of handles corresponding to the number of the directions may be provided.

In order to reinforce the part of connecting the handle 6 with the cover 4, it is preferable to provide a rib R on the cover 4 and/or add an reinforcement line H, thereby improving the rigidity of the connection part.

As shown in FIGS. 1A and 1B, the bolt holder 8 has an outer shape of a rectangular cylinder such as a square cylinder, and is provided on the top surface of the housing 2. The above screw bolt 1 is inserted in the bolt holder 8 and the engagement hole 5 can be fit in the bolt holder 8 so that the cover 4 is attached to the bolt holder 8.

A locking protrusion 8*a* is formed on at least one side of the outer periphery of the bolt holder 8 or preferably, oppositely to the outer periphery of the bolt holder 8 as seen from FIG. 1A. The bolt holder 8*a* is removably fit into any of locking recesses 5*a* formed for each about 90° at four inner edges of the planar engagement hole 5 corresponding to the bolt holder 8 formed in the cover 4 so that the rotation of the cover 4 for the bolt holder 8 is prevented to determine the direction of attaching the handle 6. Thus, the electric wires 3 on the handle 6 can be easily and surely bound with tape 7.

Figure 1C:
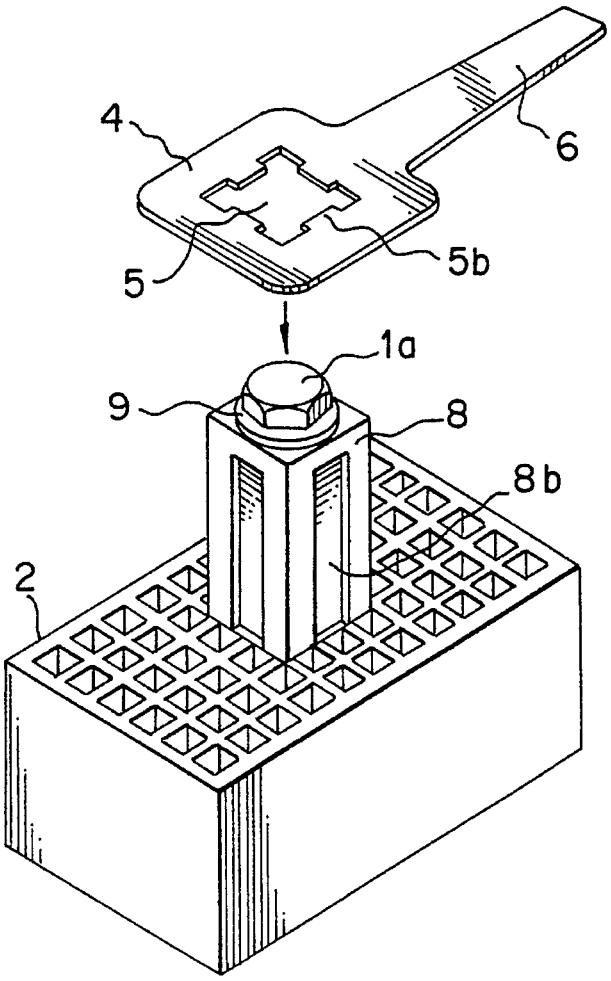
Figure 1D:
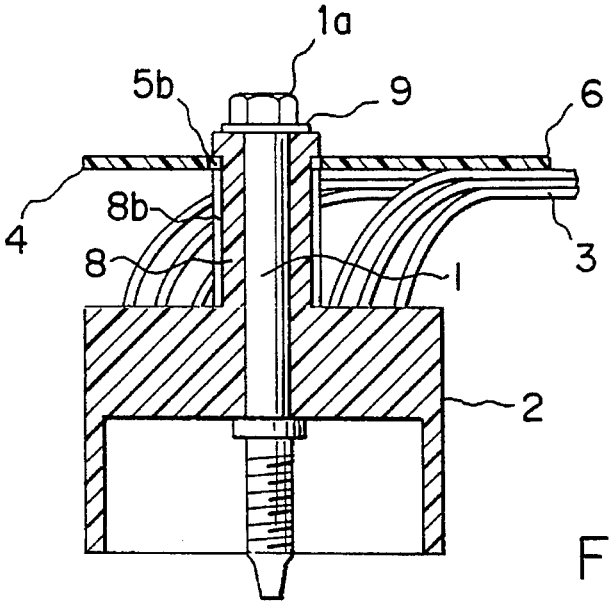
Figure 2:
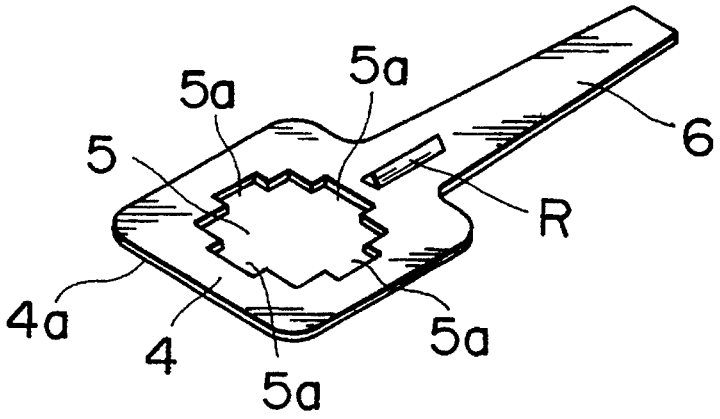
FIG. 2 is a perspective view of one example in which the present invention is put into practice.
Figure 3:
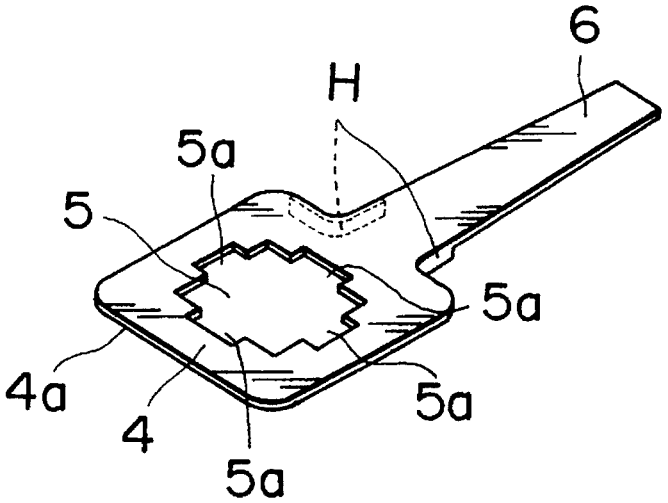
FIG. 3 is a perspective view of another example in which the present invention is put into practice.

As shown in FIGS. 1C and 1D, unlike the above case, the locking protrusion 5*b* may be formed at the inner edges of the engagement hole 5 and recesses 8*b* from which the engagement holder is removable may be provided for each about 90° in the outer periphery of the bolt holder 8 so that the rotation of the cover 4 can be prevented. Incidentally, a washer plate 9 is inserted into the lower face of the head 1*a* of the screw bolt 1.

Figure 4A:
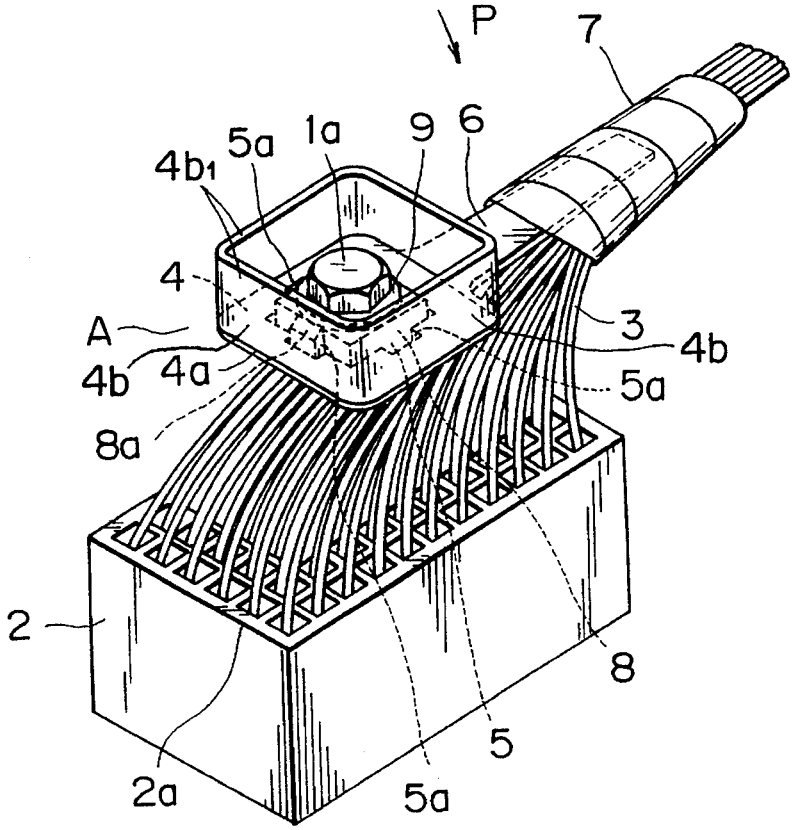
FIG. 4A is a perspective view of still another example in which a guide wall is provided in the periphery of the cover according to the present invention.
Figure 4B:
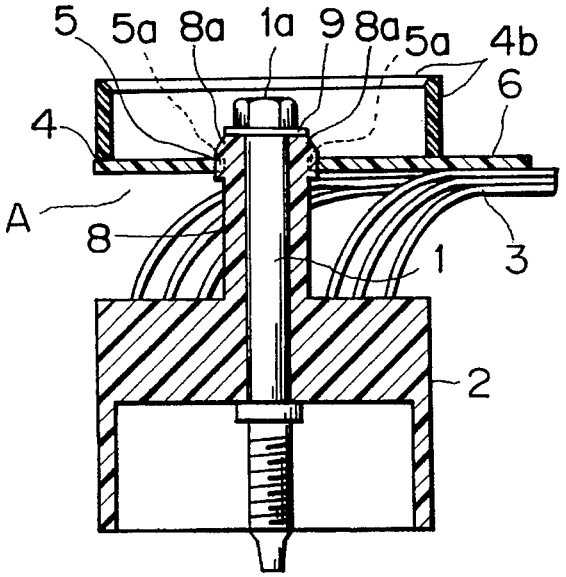
FIG. 4B is a cross sectional view of the cover shown in FIG. 4A.
Figure 5A:
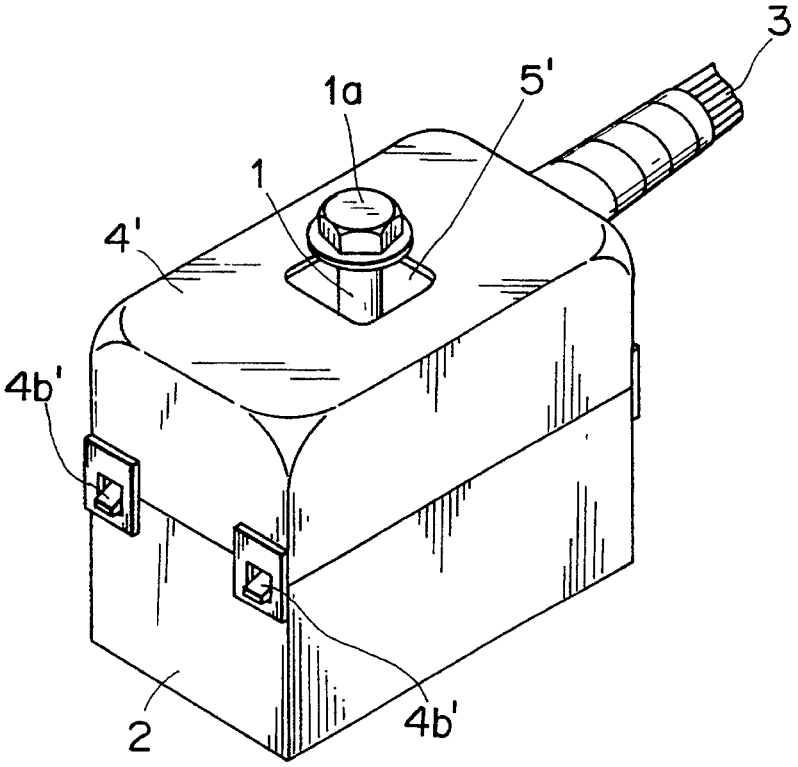
FIG. 5A PRIOR ART
FIG. 5A is a perspective view of the prior art cover.
Figure 5B:
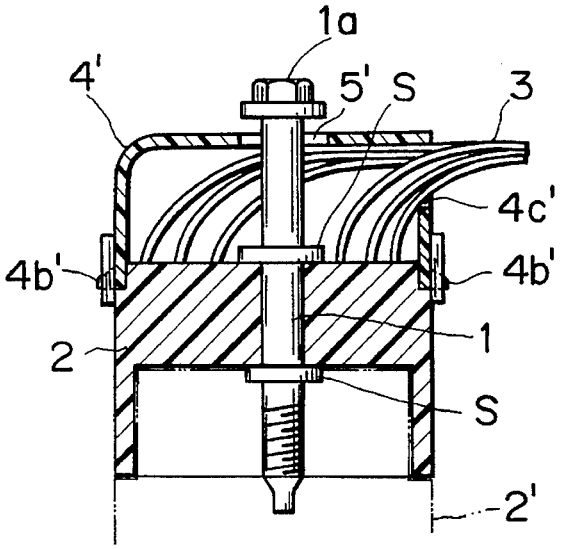
FIG. 5B PRIOR ART
FIG. 5B is a sectional view of the cover shown in FIG. 5A.

FIGS. 4A and 4B show another embodiment of the present invention. In this embodiment, guide walls 4*b* having chamfered faces 4*b*1 around the bolt holder 8 from which the head 1*a* of the screw bolt 1 projects are provided around the cover 4. In this way, the insertion or setting of a wrench (not shown) as a screwing tool for the screw bolt 1 can be quickly guided in the dark, thereby improving efficiency in the operation of screwing the bolt. Further, also in the embodiment of FIGS. 2 and 3, the guide wall 4*b* for guiding the insertion of the wrench 4 is provided around the cover 4.

In the above arrangements, the inner edge of the engagement hole 5 on the approaching side of the cover 4, i.e., side where the handle 6 is provided is hung to the outer edge of the bolt holder 8 having the outer shape of a rectangle cylinder such as a square cylinder. In this state, when the handle 6 is pressed down in the direction of an arrow P, the bolt holder 8 will be fit in the engagement hole 5. In addition, the locking projections 8*a* are locked so as to be engaged in the recesses 5*a* provided at the inner edges of the engagement hole 5 so that the cover 4 is firmly fixed. Thus, the attaching position of the cover 4 is determined and the rotation of the cover 4 can be prevented.

In this case, the locking recesses 5*a* are formed for each about 90° at four inner edges of the engagement hole 5 and the locking projections 8*a* are formed at the outer edges of the bolt holder 8 of the housing 2. For this reason, by changing the attaching direction by 90° when the cover 4 is attached, the direction can be selected from the four directions in accordance with the direction of extracting the electric wires 3.

A large number of electric wires 3 extracted from the housing 2 are bound with tape 7 around the handle 6 formed at one side of the cover 4. Thus, extraction and fixing of the electric wires of the cover 4 is completed.

In accordance with the present invention, a large number of electric wires in a bolt-screwed type high-density multi-pole connector are protected in such a manner that the cover is fit in the bolt holder. In this case, unlike the prior art, the operation of thrusting electric wires into the cover can be done without and the direction of extracting the electric wires is fixed so that the operability is improved and troubles such as breaking of electric wires due to catching thereof can be removed.

Since the cover is made smaller than the back face of the housing, particularly the one side of the cover is made shorter than the shorter side of the housing, the direction of extracting electric wires can be optionally selected. Further, the shape of the cover is so simple that the production cost can be reduced.

We claim:

1. A cover for protecting a large number of electric wires in a housing, having an outside upper surface, of a bolt-screwed type high density multi-pole connector having a screw bolt, said cover comprising:

a plate-shape cover having substantially planar upper and lower surfaces, wherein said substantially planar lower surface of said plate-shape cover faces said outside upper surface of said housing;

an engagement hole corresponding to a bolt holder having a substantially rectangular cylinder shape in which a screw bolt is inserted, wherein said substantially planar lower surface, in its entirety, extends along in substantial parallel to said outside upper surface of said housing; and a handle for fixing the electric wires by tape binding on at least one side of the cover.

2. A cover according to claim 1, wherein a locking projection and a recess in which said locking projection is removably fit for each predetermined angle are provided at the outer periphery of said bolt holder and the inner edge of the engagement hole, respectively.

3. A cover according to claim 1, wherein a locking projection and a recess in which said locking projection is removably fit for each predetermined angle are provided at the inner edge of the engagement hole and the outer periphery of said bolt holder, respectively.

4. A cover according to claim 1, wherein four locking projections and four recesses in which said locking projections are removably fit for each 90 degree are provided at the inner edge of the engagement hole and the outer periphery of said bolt holder, respectively.

5. A cover according to claim 1, wherein four locking projections and four recesses in which said locking projections are removably fit for each 90 degree are provided at the outer periphery of said bolt holder and the inner edge of the engagement hole, respectively.

6. A cover according to claim 1, wherein guide walls for inserting a screwing tool for said screw bolt are provided around the bolt holder from which the head of the screw bolt projects.

7. A cover according to claim 2, wherein guide walls for inserting a screwing tool for said screw bolt are provided around the bolt holder from which the head of the screw bolt projects.

8. A cover according to claim 3, wherein guide walls for inserting a screwing tool for said screw bolt are provided around the bolt holder from which the head of the screw bolt projects.

9. A cover according to claim 4, wherein guide walls for inserting a screwing tool for said screw bolt are provided around the bolt holder from which the head of the screw bolt projects.

10. A cover according to claim 5, wherein guide walls for inserting a screwing tool for said screw bolt are provided around the bolt holder from which the head of the screw bolt projects.

* * * * *